US006715390B1

(12) United States Patent
Flader

(10) Patent No.: US 6,715,390 B1
(45) Date of Patent: Apr. 6, 2004

(54) WOOD WORKING MACHINE

(76) Inventor: Tom R. Flader, 729 E. Dividsion St., Fond du Lac, WI (US) 54935

( * ) Notice: Subject to any disclaimer, the term of this patent is extended or adjusted under 35 U.S.C. 154(b) by 0 days.

(21) Appl. No.: 10/273,593

(22) Filed: Oct. 21, 2002

(51) Int. Cl.[7] ..... B26D 7/01; B27B 27/02

(52) U.S. Cl. ..... 83/438; 83/468.7; 144/253.1; 144/253.5

(58) Field of Search ..... 83/444, 438, 468.7; 409/218; 144/253.1, 253.2, 253.5; 269/236, 303

(56) References Cited

U.S. PATENT DOCUMENTS 4,206,910 A * 6/1980 Biesemeyer ..... 83/438 X
4,817,482 A * 4/1989 Dunaway, Jr. et al. ..... 83/438
5,460,070 A * 10/1995 Buskness ..... 83/438
6,041,837 A * 3/2000 Hanson ..... 144/253.5 X

* cited by examiner

*Primary Examiner*—W. Donald Bray
(74) *Attorney, Agent, or Firm*—Jon C. Gealow

(57) ABSTRACT

For a woodworking machine having a horizontally disposed working table with a top planar surface and a saw blade transverse to the table, there is provided an elongated work-retainer fence having a planar facing disposed substantially perpendicular to the planar surface of the table. The work-retainer fence is spaced from the saw blade and parallel to the line of the saw blade; and the fence includes at least one horizontally disposed support that is substantially normal to the planar facing of the fence and is distended outwardly from at least one of the marginal edges of the table. The support has a substantially top planar surface that is substantially co-planar with the planar surface of the working table.

4 Claims, 3 Drawing Sheets

WOOD WORKING MACHINE

FIELD OF THE INVENTION

This invention relates to a woodworking table saw machine. In its more specific aspect, this invention relates to a woodworking table saw machine utilizing a horizontally disposed rip fence for guiding the workpiece through the saw blade.

BACKGROUND OF THE INVENTION

For general woodworking purposes, a table saw, having a rotary saw blade or an endless saw blade, is useful in the woodworking shop. A work-retainer fence having a planar facing disposed perpendicular to the table which is parallel to and adjustably spaced from the saw blade, is used to guide the work piece. However, a known and common problem related to smaller table saws, often referred to in the trade as contractor saws because of their portability, is that when sawing (i.e. ripping) long pieces of wood, it is difficult to feed the wood piece into the saw blade properly since there is very little of the saw table and rip fence extending to the front of the saw blade to support and guide the work piece. A misaligned work piece can be ruined, or worse, can be hazardous to the operator in that the work piece can be kicked back by the rotating saw blade, possibly injuring the operator.

This invention has therefore as its object to provide a self-aligning extension for the saw table and rip fence.

SUMMARY OF THE INVENTION

Broadly, the invention relates to an improved woodworking machine provided with a horizontally disposed working table having a width defined by a front marginal edge (that edge toward the workman) and an opposed back marginal edge, and includes a saw blade transverse to the table, such as a rotating saw blade. An elongated work-retainer fence is arranged adjacent the table and extends beyond the opposed, front and back marginal edges of the table. The term"fence" is sometimes referred to in the art as a"rip fence," and it is understood that the two terms as used herein and in the appended claims, are synonymous. The fence has a planar vertical facing disposed perpendicular to the working table, and is parallel with, and adjustably spaced from the saw blade and parallel to the line of the saw blade. Preferably, the fence is substantially rectangular as viewed in transverse cross-section. The fence, along its longitudinal axis, is mounted perpendicular to the table and extends beyond the front and/or rear marginal edge of the table. At least one horizontally disposed support extends transversely from at least one end of the fence and is substantially perpendicular to the planar vertical facing of the fence so that the support is distended beyond at least one of the marginal edges of the table. Further, the support has a substantially planar top surface that is substantially co-planar with the planar surface of the working table. It thus will be observed that at least some portion of the work piece is borne by the support, whereby the blade will cut more true.

Where desired, the support may be integral with the fence as provided with the machine by the manufacturer, or the support may be a separate member attachable to the fence. Thus, the support can be part of the original equipment, or can be attached by the workman when needed, or can be acquired separately from the machine and retrofitted for the after market.

In a preferred embodiment of the invention, a horizontally disposed support extends transversely from each end of the fence, and each support is substantially perpendicular to the planar vertical facing of the fence so that the supports are distended beyond the front and back marginal edges of the table. Further, each support has a substantially planar top surface that is substantially co-planar with the planar surface of the working table. It thus will be observed that at least some portion of the work piece is borne by the supports, whereby the blade will cut more true, and the workpiece will have less tendency to fall off the rear of the saw table as it proceeds through the blade and becomes overbalanced.

BRIEF DESCRIPTION OF THE ACCOMPANYING DRAWINGS

The invention and its advantages will be more readily understood by reference to the following detailed description and exemplary embodiments when read in conjunction with the following drawings, wherein.

DETAILED DESCRIPTION OF THE INVENTION

Figure 1:
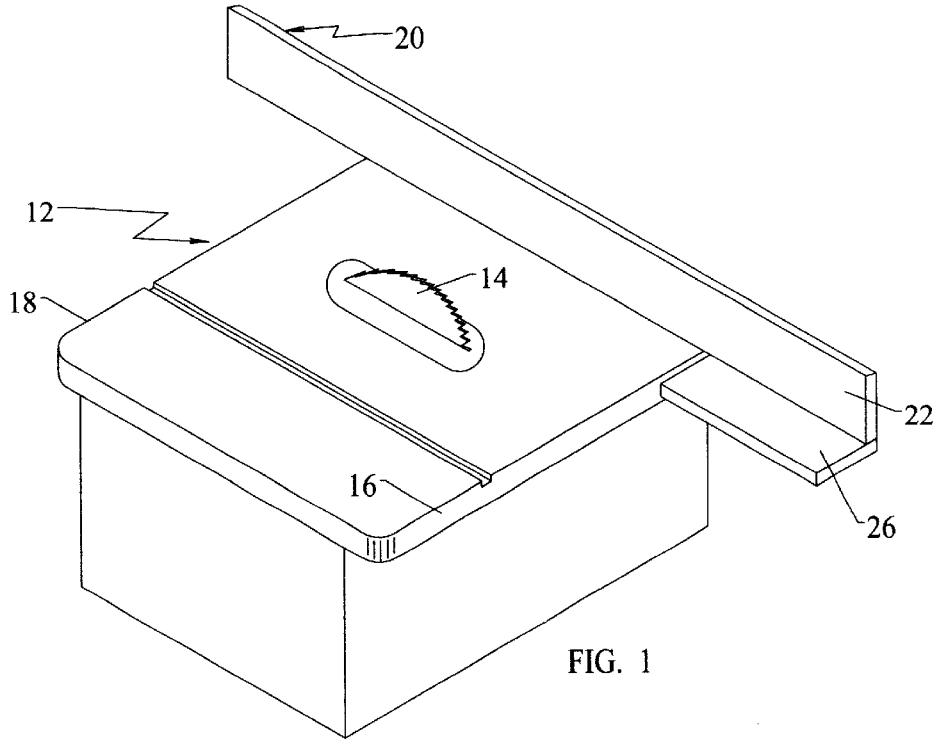
FIGS. 1 is a perspective view of a typical saw machine showing a horizontal table and a vertical saw blade and utilizing the fence with the support means of my invention.
Figure 2:
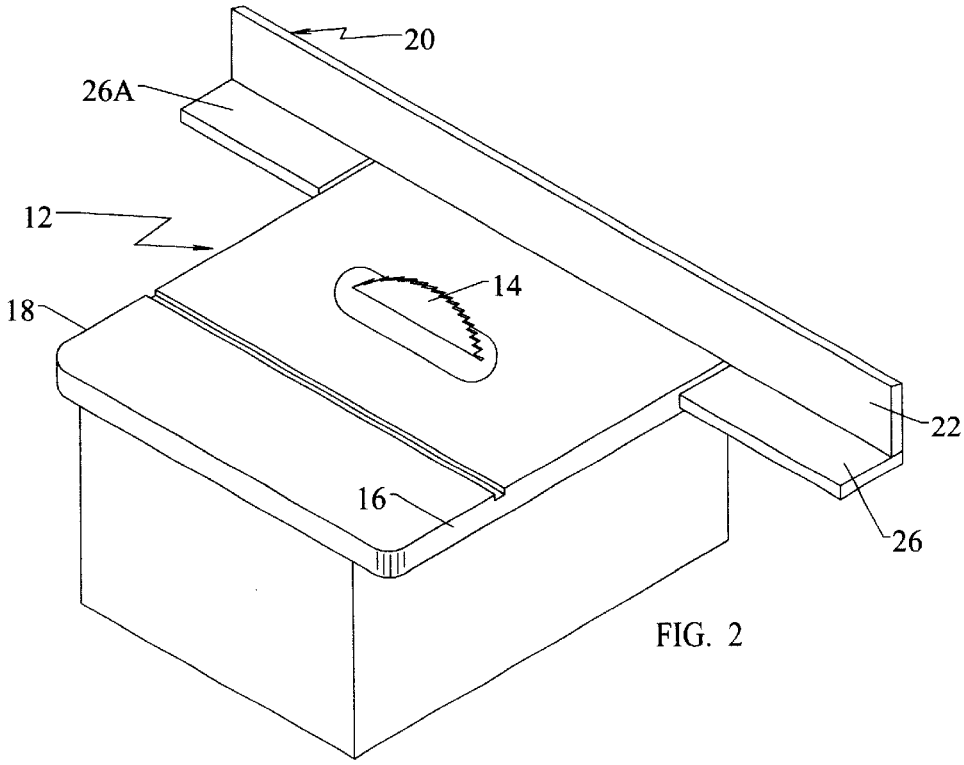
FIG. 2 is a perspective view similar to FIG. 1 showing an alternative embodiment of the fence with the support means of my invention.
Figure 3:
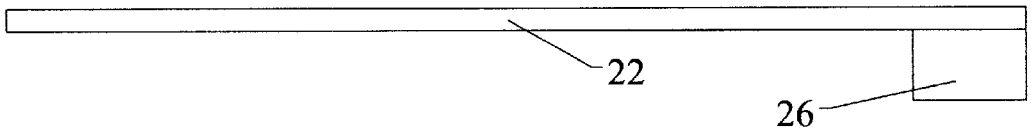
FIG. 3 is a plan view of the fence of FIG. 1.
Figure 4:
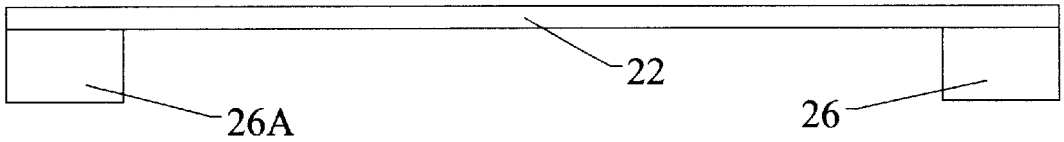
FIG. 4 is a plan view of the fence of FIG. 2.
Figure 5:
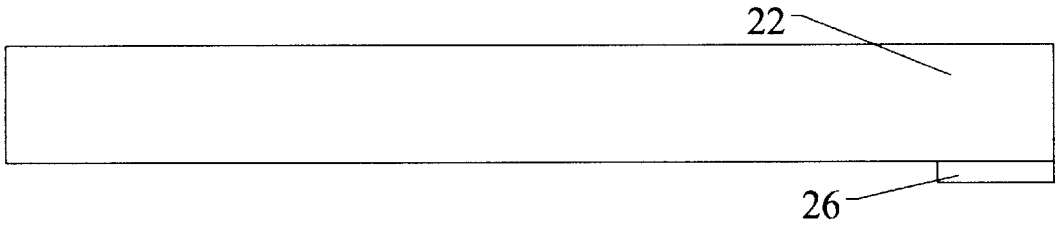
FIG. 5 is a side elevational view of the fence of FIG. 1.
Figure 6:
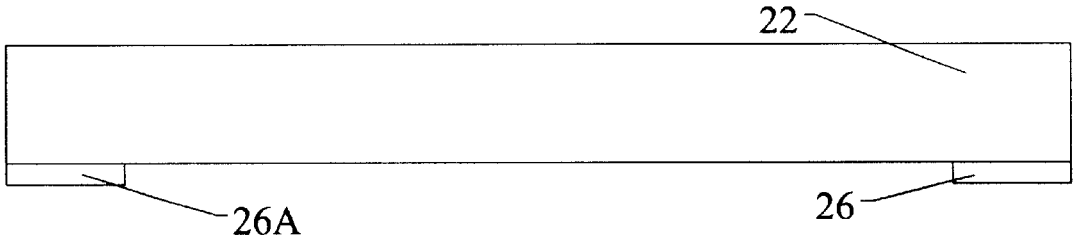
FIG. 6 is a side elevational view of the fence of FIG. 2.
Figure 7:
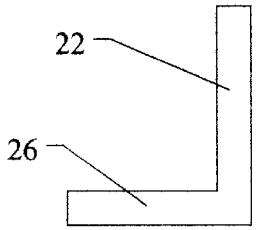
FIG. 7 is an end view of the fence of FIGS. 1 or 2.

In referring to the drawings, wherein like reference numerals designate similar parts throughout the several views, there is illustrated in FIG. 1 and FIG. 2 a typical wood working machine, generally indicated by the numeral 10, having a horizontally disposed working table 12 and using a vertically disposed blade 14, such as a rotatable saw blade or endless band saw blade, with a suitable motor means (not shown) for driving the saw blade. It will be observed that the working table 12 has a forward marginal edge 16 (forward relative to the position of the workman) and an opposed rear marginal edge 18. An elongated fence or work-retainer fence 20 is adjustably mounted on the table and between the opposed, front and back marginal edges 16 and 18, respectively, so that the position of the fence can be adjusted relative to the saw blade. The work-retainer fence has a substantially rectangular configuration as viewed in transverse cross-section (see FIG. 7), and has a planar vertical surface 22. The fence can be of any desirable material such as wood, metal or plastic, or a combination of materials. The longitudinal axis of the fence is parallel with the line of the saw blade, and when mounted, is perpendicular to the table and is spaced from the saw blade and parallel to the line of the saw blade.

The fence 16 is provided with a suitable clamping or fastening means (not shown) which can be adjusted to secure the fence to the table and hold it fast in the desired position. The fence 20 includes a horizontally disposed support or shoulder 26 depending substantially perpendicular to the planar vertical facing 22. It will be observed that the support 26 is so positioned relative to the working table 12 and fence 20 as to distend beyond the marginal edge 16 of the table, as shown in FIG. 1. As shown in the drawings, the edge of the support does not engage the marginal edge 16 of the table so as to allow for any desired positioning or adjusting of the fence. Further, support 26 has a planar top surface as shown in the drawings that is substantially co-planar with the planar surface of the working table.

It thus will be observed that as a working piece, having a length exceeding that of the table surface, is fed through the saw, the end of the working piece rests on the support or shoulder 26. Thus, pieces that extend beyond the edge of the table are supported by the shoulder 26, thereby avoiding any wobbling of the work piece. In this manner, true alignment is achieved in that the angle the blade cuts true because the work piece tracks essentially exactly perpendicular to the front or leading edge of the saw blade.

An alternative embodiment of the invention is shown in FIG. 2. Accordingly, a fence is provided with horizontally disposed supports or shoulders 26 and 26A, which are essentially identical, and extend transversely from the fence and distend beyond the opposed marginal edges 16 and 18 of the working table 12. This embodiment is advantageous in that long pieces can be supported at both ends as the sawing progresses in that as the wood piece first contacts the saw blade, the piece is supported by shoulder 26, and as the wood piece progresses through the saw blade, the piece rests on the shoulder 26A. In this manner, any wobble of the work piece is essentially eliminated.

Figure 8:
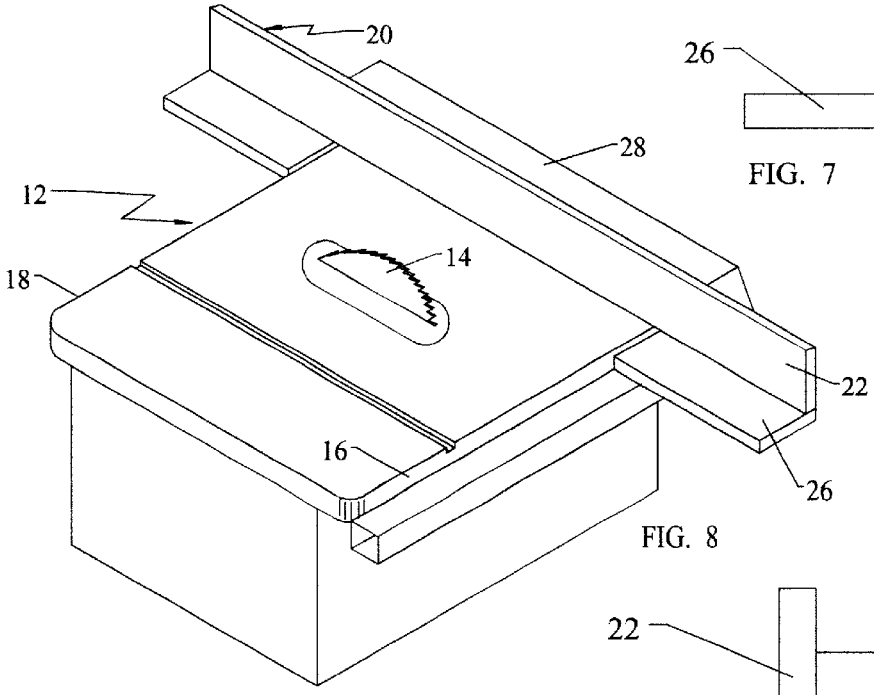
FIG. 8 is perspective view of a typical saw machine similar to that as shown in FIG. 1 utilizing the support means attachable to a separate fence such as provided by the manufacturer.
Figure 9:
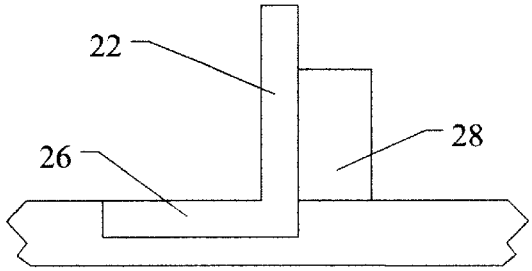
FIG. 9 is an end view of the combination of the support means and fence as shown in FIG. 8.
Figure 10:
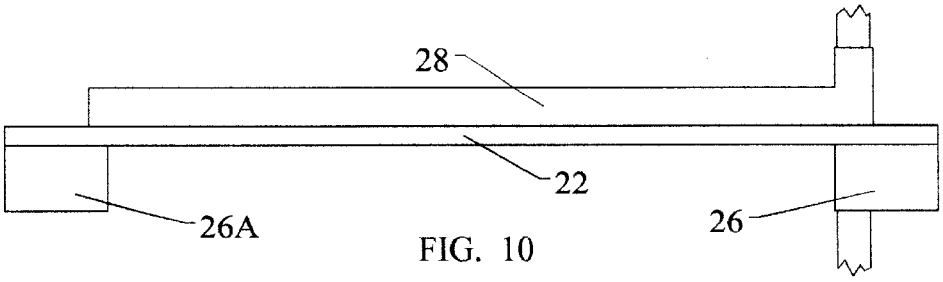
FIG. 10 is a plan view of the support means and fence of FIG. 8

In accordance with the embodiment showing in FIGS. 8–10, the work-retainer fence with the support is separate from the fence provided by the manufacturer. Thus, fence 20 is attachable to the conventional fence 28 provided with the table. Any suitable fastening means can be employed for attaching the two members, such as countersunk screws, nut and bolt, or clamps, but the fastening means should not protrude into the working area which then would interfere with the positioning of the work piece. This embodiment is advantageous in that the fence 20 of the invention can be readily retrofit to an existing machine, or the fence 20 can be used as desired or needed.

It will be observed that the fence apparatus of my invention provides for several advantages, including the fact that the apparatus is not complicated to use and requires no special or unusual skill. Further, it should be understood that the foregoing detailed description has been given for clearness of understanding only, and no unnecessary limitations should be understood therefrom, as modifications will be obvious to those skilled in the art.

What is claimed is:

1. In a woodworking machine having a horizontally disposed working table having a top planar surface, a saw blade transverse to the table, an elongated work-retainer fence having a planar facing disposed substantially perpendicular to said planar surface and spaced from the saw blade and parallel to the line of the saw blade; said fence including at least one horizontally disposed support that is substantially normal to said planar facing of said fence and is distended outwardly from at least one of the marginal edges of said table, said support having a substantially top planar surface that is substantially co-planar with said planar surface of said working table.

2. In a woodworking machine in accordance with claim 1 wherein said support is distended outwardly from the opposed marginal edges of said table.

3. In a woodworking machine in accordance with claim 1 wherein said wood working machine includes a second fence outwardly disposed relative to said work-retainer fence, and said work-retainer fence is adaptable to be secured to said second fence.

4. In a woodworking machine in accordance with claim 2 wherein said wood working machine includes a second fence outwardly disposed relative to said work-retainer fence, and said work-retainer fence is adaptable to be secured to said second fence.

* * * * *